US007524212B2

(12) United States Patent
Williams

(10) Patent No.: US 7,524,212 B2
(45) Date of Patent: Apr. 28, 2009

(54) RECESSED JACK AND JACK PLUG ASSEMBLY

(75) Inventor: Bruce Allen Williams, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/020,976

(22) Filed: Jan. 28, 2008

(65) Prior Publication Data

US 2008/0299822 A1 Dec. 4, 2008

Related U.S. Application Data

(63) Continuation-in-part of application No. 11/620,355, filed on Jan. 5, 2007, now abandoned.

(51) Int. Cl.
*H01R 24/04* (2006.01)

(52) U.S. Cl. ..... 439/668; 439/669; 439/675

(58) Field of Classification Search ..... 439/668, 439/669, 650, 542, 544, 545, 550, 554, 528, 439/529, 675

See application file for complete search history.

(56) References Cited

U.S. PATENT DOCUMENTS 7,322,858 B1 * 1/2008 Rogers et al. ..... 439/669
2008/0233805 A1 * 9/2008 Wang et al. ..... 439/668

* cited by examiner

*Primary Examiner*—Hae Moon Hyeon
(74) *Attorney, Agent, or Firm*—Shook, Hardy & Bacon LLP

(57) ABSTRACT

A recessed jack plug assembly includes a jack plug support structure having a jack plug mounted therein. The jack plug support structure includes a recessed area for receiving at least a portion of the base of the jack. The recessed area includes an interior wall which provides lateral support to the base of the jack. The recessed area may also have a channel to accommodate the angled portion of a 90° jack base. A pair of opposed finger wells are optionally provided in the front surface of the jack plug support structure adjacent the recessed area to allow the user to grasp the base of the jack when removal of the jack is desired.

20 Claims, 5 Drawing Sheets

RECESSED JACK AND JACK PLUG ASSEMBLY

TECHNICAL FIELD

The present invention relates generally to plugs for receiving audio and video jacks. More particularly, the present invention relates to a recessed jack plug having a recessed area that provides lateral support to the base of the jack when the jack is inserted into the jack plug.

BACKGROUND OF THE INVENTION

In the automotive industry many vehicles are fitted with remote headphone jack plugs for vehicle passengers. This allows a passenger to plug a headphone into the vehicle's sound system to access either the audio or the family entertainment system independent of the vehicle's speaker system. The headphone jack commonly used in such applications is a standardized electrical connector pin. The electrical headphone receptacle or jack plug can be located in any of a number of locations including trim panels and on the rear side of the floor center console. Regardless of placement, the jack plugs are either flush with or protrude slightly from the mounting surface. According to this known arrangement the headphone jack, when inserted into the jack plug, protrudes into the passenger space without any support. Forces accidentally applied to the sides of the jack, or to the wires connecting the jack to the headphone, place stress on the plastic around the plug opening and on the electrical contact in the plug. These forces may be caused by any of a number of events, including foot movement by the passenger and tangled wires. Frequently the result of such forces is the breaking of the plastic around the plug opening and the bending and breaking of the electrical connection in the plug. The result is intermittent or complete loss of electrical signals to the headphones.

Accordingly, as in so many areas of vehicle technology, there is room in the art of vehicle audio systems for improving electrical connections for headphones.

SUMMARY OF THE INVENTION

The present invention provides a recess in the plug opening into the mounting structure to reduce the amount the headphone jack protrudes from the mounting surface when the jack is inserted into the jack plug. The present invention further provides lateral support to the body of the headphone jack and minimizes stress on the plug opening and the electrical contacts. Recessing the jack plug hole will create a column into the mounting surface, such as the trim panel. The size of the recessed column is slightly larger than the outer diameter of the headphone jack body. The depth of the recessed column is preferably about one-half the length of the jack plug body. The recessed area may also have a ramped surface to accommodate the angled portion of a 90° jack base. A pair of opposed finger wells are optionally provided in the front surface of the jack plug support structure adjacent the recessed area to allow the user to grasp the base of the jack when removal of the jack is desired. As a further variation of the present invention a plurality of support structures protruding from the inner wall of the recessed column may be provided for direct contact to the jack plug when the plug is inserted into the recessed column.

Other advantages and features of the invention will become apparent when viewed in light of the detailed description of the preferred embodiments when taken in conjunction with the attached drawings and the appended claims.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
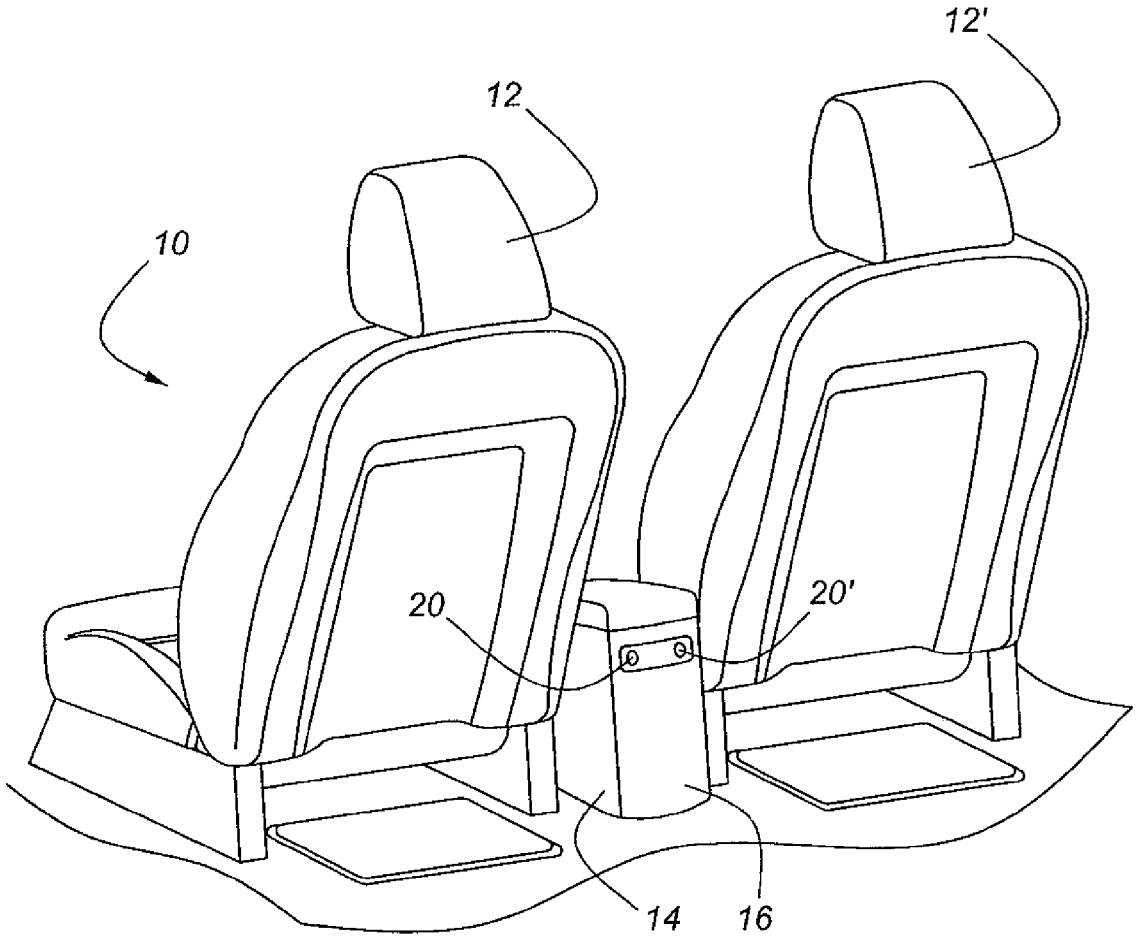
FIG. 1 illustrates a portion of a vehicle interior as a preferred environment for the recessed jack plug and further illustrates a recessed jack plug fitted therein.

In the following figures, the same reference numerals will be used to refer to the same components. In the following description, various operating parameters and components are described for one constructed embodiment. These specific parameters and components are included as examples and are not meant to be limiting.

With reference to FIG. 1, a portion of a vehicle interior, generally illustrated as 10, is shown. The vehicle interior 10 includes a pair of vehicle seats 12, 12' having a console 14 fitted therebetween. The console 14 has a back portion 16. Disposed on the back portion 16 is a pair of recessed jack assemblies, 20, 20'. It should be understood that while the jack assemblies 20, 20' are situated on the back portion 16 of the console 14, the jacks according to the present invention may be situated in a variety of places in the vehicle, including, but not limited to, positions elsewhere on the console as well as on the instrument panel or on the vehicle ceiling. Accordingly, the illustrated placement of the recessed jack assemblies 20, 20' on the back portion 16 of the console 14 is only suggestive but is not intended to being limiting.

It is also to be understood that while the recessed jack of the present invention is illustrated in the interior of a vehicle, other applications are possible, including other forms of passenger transport, such as airplanes, buses and trains. Furthermore, the recessed jacks of the present invention may have applications outside of the transportation industry and may be used, for example, on portable and non-portable radios and music equipment as well as in built-in home and office audio systems.

Figure 2:
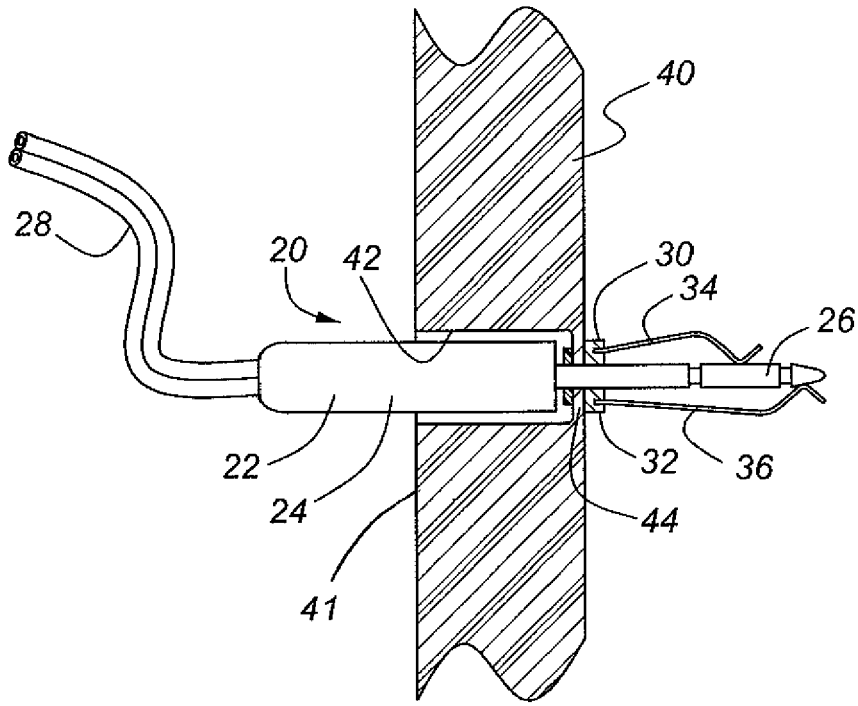
FIG. 2 illustrates a sectional view of a recessed jack plug according to the present invention showing a jack in place within the recessed jack plug.

With respect to FIG. 2, a sectional view of the recessed jack assembly 20 of the present invention is illustrated. The recessed jack plug assembly 20 includes a jack 22 having a base 24 and a pin 26 as is known. Extending from the base 24 is a power line 28 for connection with headphones or other electronic audio or video equipment (not shown). The jack 22 may be of the audio (stereo or mono) or video variety and thus the utility of the present invention is not to be limited by the type of plug used. Any known electrical plug may be used with the present invention without deviating from its spirit and scope. The illustrated jack 22 is of the stereo audio type however the illustrated jack 22 is intended as being illustrative rather than limiting.

The recessed jack plug assembly 20 of the present invention further includes a jack plug 30 for receiving and retaining the jack 22. The jack plug 30 includes a body 32 having extending therefrom a first pin contact arm 34 and a second pin contact arm 36. The arms 34, 36 are conventionally used with a stereo jack, such as the illustrated jack 22. Again, however, the jack plug 30 and its arms 34, 36 are intended as being illustrative rather than limiting.

The recessed jack plug assembly 20 of the present invention additionally includes a jack plug support structure 40. In its preferred application, the support structure 40 may be part of a vehicle instrument panel or may be part of an audio/video panel positioned in a variety of locations in (or out of) a vehicle. The jack plug support structure 40 includes a front surface 41 and a recessed column 42 having a plug end 44. The interior wall of the recessed column 42 need not be in physical contact with the outside of the base 24 of the jack 22 (otherwise removal of the jack 22 from the jack plug support structure 40 might be difficult) but the distance between the two should be such that the recessed column 42 provides lateral support to the base 24 of the jack 22 in the event that the base 24 is pushed to one side or is pulled to another. Accordingly, a marginal gap between the interior wall of the recessed column 42 and the base 24 of the jack 22 as illustrated is desired.

Figure 3:
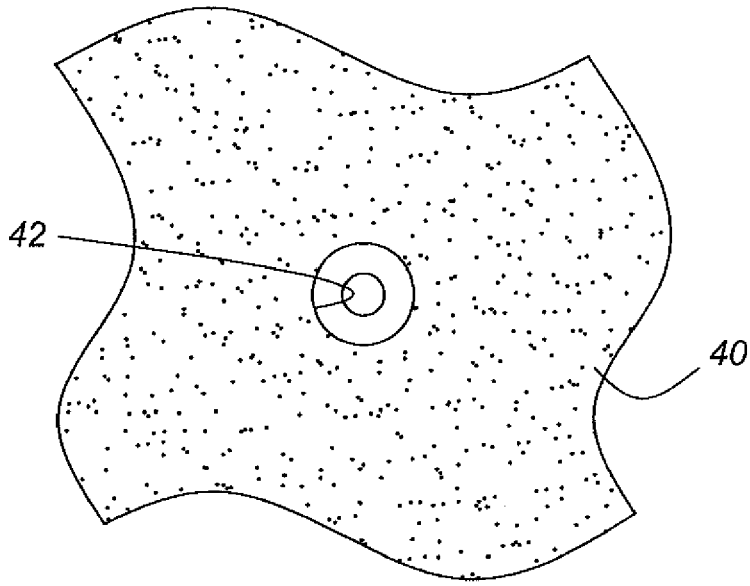
FIG. 3 is a front view of the receptacle of the present invention shown in FIG. 2.

Referring to FIG. 3, a front view of the jack plug support structure 40 having a jack receptacle of the present invention shown in FIG. 2 is illustrated. The jack plug support structure 40 may be made of a variety of materials, although it is preferable that the material be of the polymerized type that is commonly used in vehicle interior applications. The face of the support structure 40 has a mottled appearance but, of course, any other appearance would be suitable.

Figure 4:
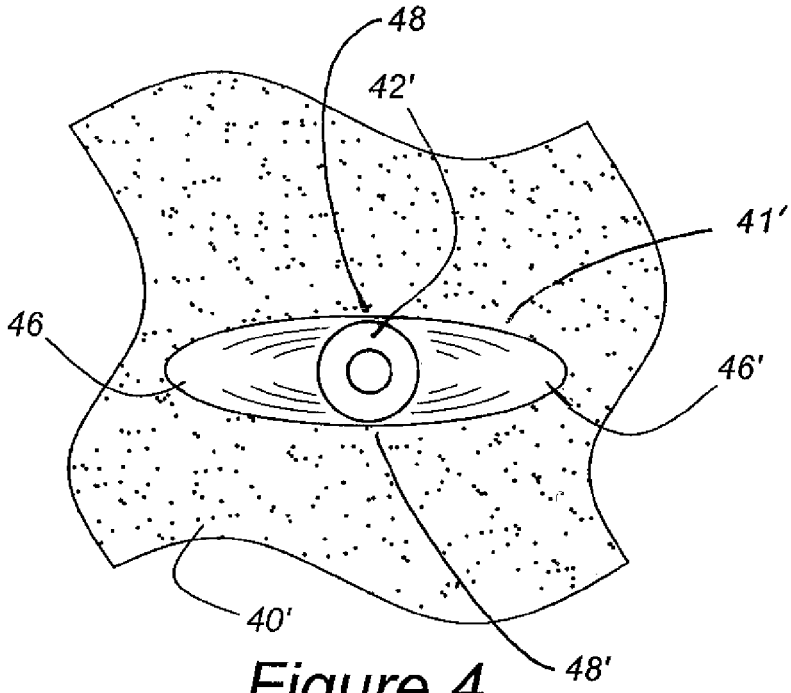
FIG. 4 is a front view of an alternate embodiment of the receptacle of the present invention illustrating finger wells for grasping the jack.

An alternate embodiment to the jack plug support structure 40 of FIG. 3 is shown in FIG. 4. In this figure a jack plug support structure 40' is illustrated. The jack plug support structure 40' includes a front surface 41' and a recessed column 42'. Adjacent both sides of the recessed column 42' are a pair of opposed finger wells 46, 46'. The wells 46, 46' are recessed areas defined in the surface of the jack plug support structure 40' that allow the user to use the tips of fingers to grasp and remove the jack plug. While the wells 46, 46' are illustrated as being formed horizontally with respect to the recessed column 42', the wells 46, 46' may be formed vertically instead or in addition to the horizontal configuration that is illustrated. A pair of opposed support areas 48, 48' provide the base of the jack (not shown in FIG. 2) with lateral support which is partially absent in the area of the wells 46, 46' which are adjacent the recessed column 42'.

The recessed jack plug assembly of the present invention is illustrated in FIGS. 1 through 4 as being of the conventional, straight-base configuration as shown in FIG. 2. However, as an alternate approach to the present invention, the assembly may be suitable for other types of jack bases, and it may particularly be suited for use with a jack plug having a body with a 90° angle formed therein. This arrangement is illustrated in FIGS. 5 and 6.

Figure 5:
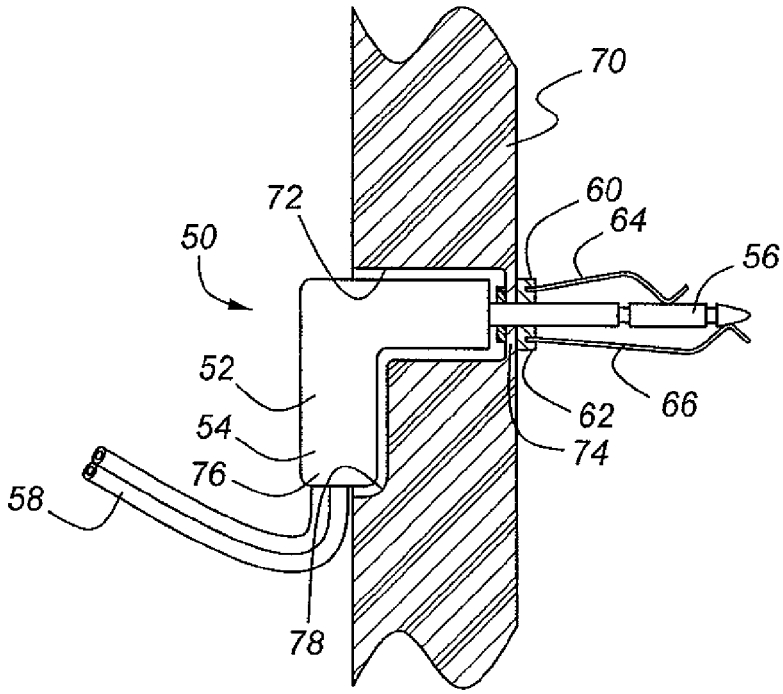
FIG. 5 illustrates a sectional view of an alternate embodiment of the recessed jack plug according to the present invention illustrating a jack in place within the alternate embodiment of the recessed jack plug.
Figure 6:
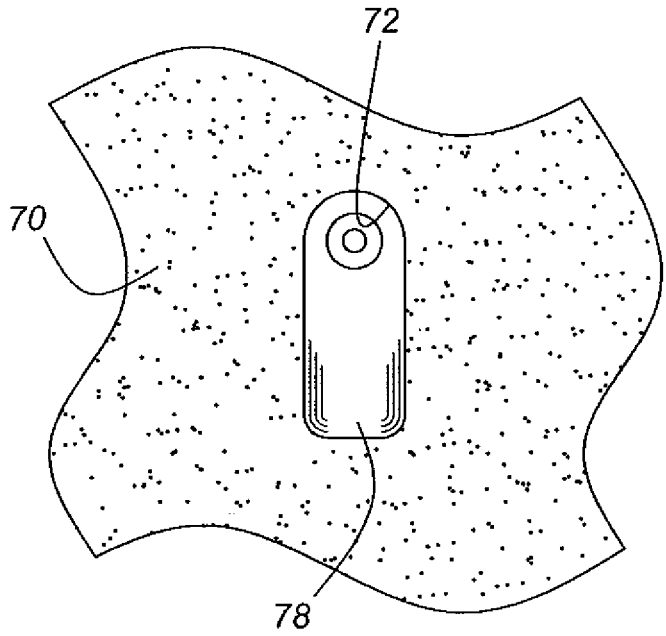
FIG. 6 is a front view of the receptacle of the present invention shown in FIG. 5 illustrating the optional finger wells for grasping the jack as well as a ramped wall to accommodate a jack having a 90° angled base.

With reference to FIG. 5, an alternate embodiment of the recessed jack plug assembly of the present invention, illustrated as recessed jack assembly 50, is shown in cross section. The recessed jack plug assembly 50 includes a jack 52 having an angled base 54 and a pin 56. A power line 58 extends from the base 54. The recessed jack plug assembly 50 further includes a jack plug 60. The jack 52 is removably insertable into the jack plug 60. The jack plug 60 includes a body 62 which includes a first pin contact arm 64 and a second pin contact arm 66. The first pin contact arm 64 and the second pin contact arm 66 extend from the body 62 of the jack plug 60.

The recessed jack plug assembly 50 is mounted in a jack plug support structure 70. The jack plug support structure 70 includes a recessed column 72 having a plug end 74. As with the interior wall of the recessed column 42 of the jack plug support structure 40 discussed above with respect to FIG. 2, the interior wall of the recessed column 72 is preferably not in direct contact with the outside of the body 54 of the jack 52 but should be close enough in proximity so that side-to-side or up-and-down motion of the body 54 within the recessed area 42 is substantially restricted.

The body 54 of the jack 52 includes an angled arm 76 which is formed at about a 90° angle with respect to the long axis defined by the rest of the body 54 and the pin 56. To accommodate the angled arm 76 of the body 54 a base extension area 78 is formed in the upper surface of the jack plug support structure 70. The base extension area 78 is configured so as to allow the jack 52 to be fully inserted into the recessed column 72 as illustrated in FIG. 5 without interference. It is to be understood that the configurations of the body 54 and the base extension area 78 are illustrative and that other configurations may be readily adapted for use with the present invention.

A front view of the jack plug support structure 70 is illustrated in FIG. 6 in which the recessed column 72 is formed. The base extension area 78 is also illustrated. While not shown, the finger wells of FIG. 4 could be formed in the jack plug support structure 70 as well.

Figure 7:
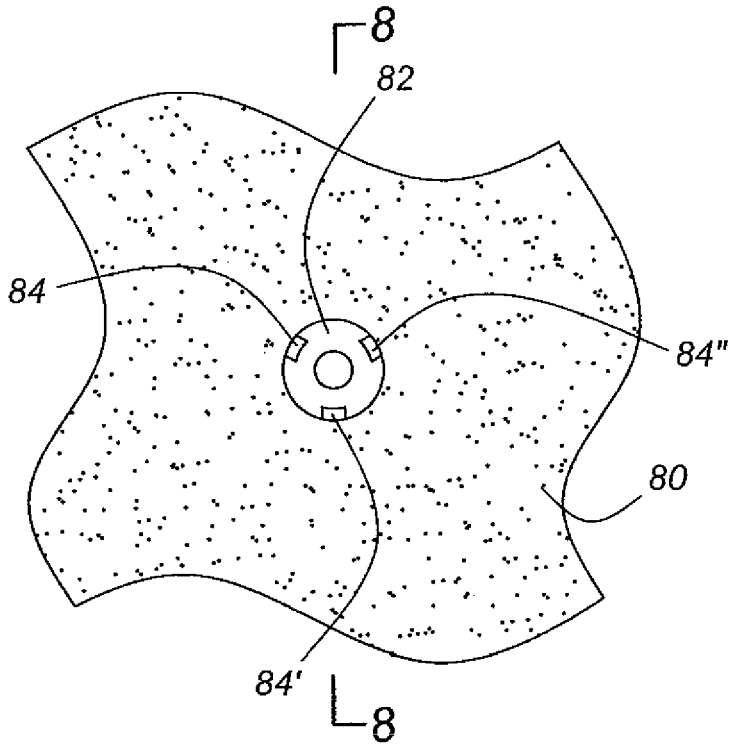
FIG. 7 is a front view of an alternate embodiment of the receptacle wall of the present invention illustrating protruding supports for providing lateral support to the base of the plug.

It may be desired that direct contact between the interior wall of the recessed area and the jack body be provided. In the embodiments set forth above, a marginal gap is provided between the interior wall of the recessed area and the body of the jack to prevent difficulty in withdrawing the jack from the plug. As a further variation of the present invention, lateral supporting structures may be provided within the recessed area for direct contact with the plug body. This configuration is illustrated in FIG. 7 wherein a jack plug support structure 80 includes a recessed column 82. The interior wall of the recessed area includes a plurality of lateral support structures 84, 84', 84" which protrude from the surface of the interior wall. When a jack (not shown) is inserted into the recessed column 82 the outer surface of its body engages the lateral support structures 84, 84', 84" thereby providing direct lateral support for the jack. Of course, a greater or lesser number of lateral support structures having the same or different configurations may be provided. The lateral support structures 84, 84', 84" may be composed of a rubber or a similar deformable material which will snugly hold the jack within the recessed column 82. The arrangement and configuration of the lateral support structures are illustrated in additional detail in FIG. 8.

Figure 8:
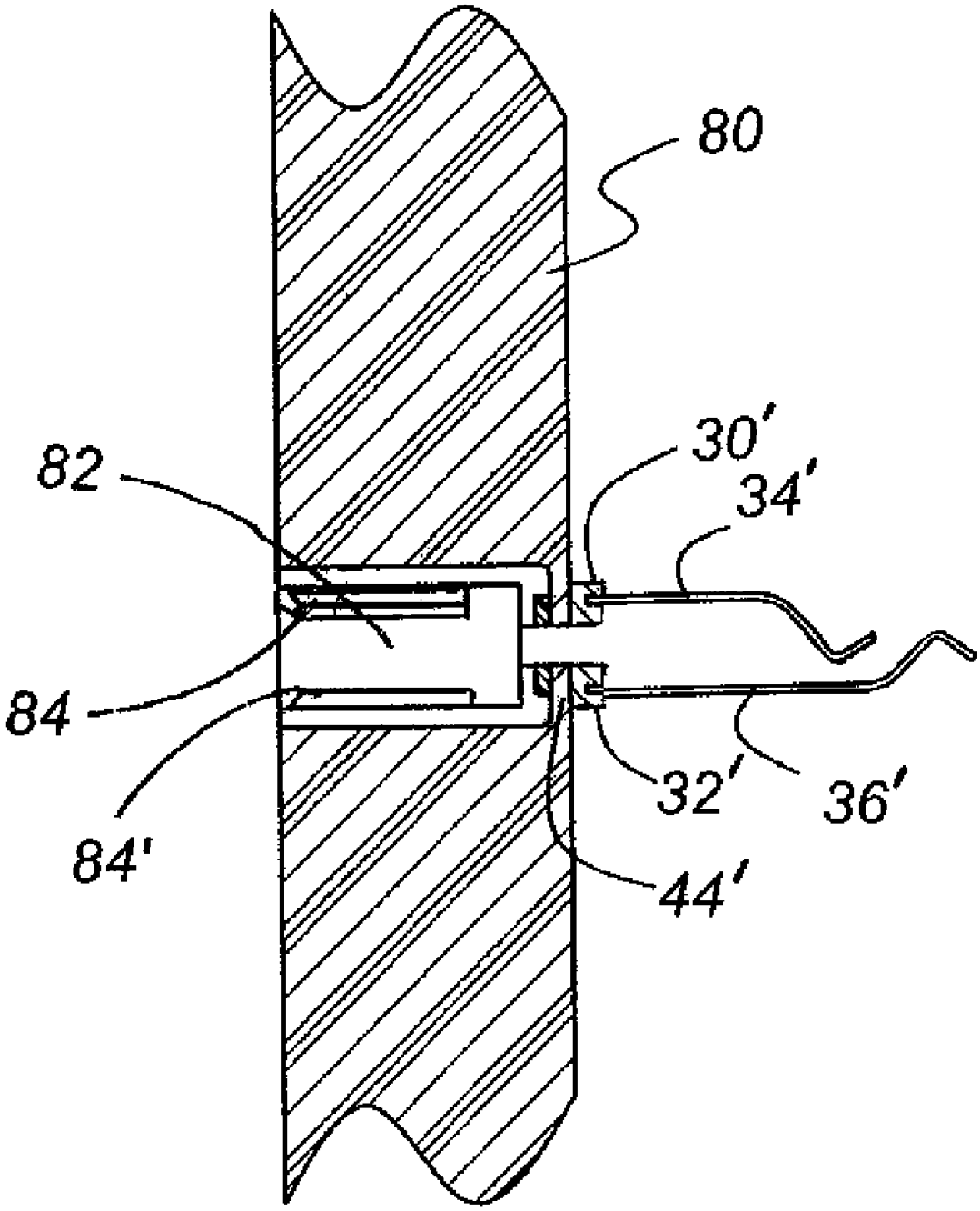
FIG. 8 is a view taken along line 8-8 of FIG. 7 and particularly illustrates the lateral support structures of the recessed column.

With respect to FIG. 8, a sectional view of an alternate embodiment of the jack plug support structure of the present invention taken along line 8-8 of FIG. 7 is illustrated. As illustrated in FIG. 8, the jack plug support structure 80 is shown in which a jack plug 30' is provided. The support structure 80 may be part of a vehicle instrument panel or may be part of an audio/video panel positioned in a variety of locations in (or out of) a vehicle. The jack plug support structure 80 includes the recessed column 82 having a plug end 44'.

As with the jack plug support structure 40 of FIG. 2, the jack plug support structure 80 is provided to receive and retain a jack. More particularly, a jack plug 30' is provided for receiving and retaining the jack (not shown). The jack plug 30' includes a body 32' having extending therefrom a first pin contact arm 34' and a second pin contact arm 36'. The arms 34', 36' are conventionally used with a stereo jack. However, the jack plug 30' and its arms 34', 36' are intended as being illustrative rather than limiting.

As shown in FIG. 8, two of the three lateral support structures, namely lateral support structures 84, 84' are illustrated. As shown, the lateral support structures 84, 84' partially extend along the length of the recessed column 82 although the lengths of the lateral support structure could be greater or lesser than that shown. As set forth above, the lateral support structures provide lateral support to the body of the jack when the jack is in position in the recessed column 82.

The foregoing discussion discloses and describes exemplary embodiments of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A jack and jack plug assembly comprising:

a jack having a base and a pin;

a jack plug for receiving said pin of said jack;

a jack plug support structure having a jack plug mounting hole in which said jack plug is mounted and a recessed area for receiving at least a portion of said base of said jack, said recessed area including a wall structure at least a portion of which is adjacent to said base of said jack when said jack is inserted into said jack plug, said jack plug support structure including a front surface and a pair of substantially opposed finger-receiving wells formed in said front surface and extending laterally from said jack plug mounting hole.

2. The jack and jack plug assembly of claim 1 wherein said wall structure of said recessed area is substantially cylindrical.

3. The jack and jack plug assembly of claim 1 further including a base extension area defined in said front surface and extending from said recessed area into which a portion of said base of said jack is fitted.

4. The jack and jack plug assembly of claim 3 wherein said base extension area defines a channel.

5. The jack and jack plug assembly of claim 1 wherein said wall structure of said recessed area includes at least one protruding element.

6. The jack and jack plug assembly of claim 5 wherein said at least one protruding element defines three protruding elements.

7. The jack and jack plug assembly of claim 5 wherein said at least one protruding element defines an elongated support structure.

8. The jack and jack plug assembly of claim 7 wherein said recessed area has a long axis and wherein said elongated support structure is formed along said long axis of said recessed area.

9. The jack and jack plug assembly of claim 6 wherein each of said three protruding element defines an elongated support structure.

10. A receptacle for a jack, the jack having a base and a pin, the receptacle comprising:

a jack plug for receiving the pin of the jack;

a recessed area for receiving at least a portion of the base of the jack, said recessed area having a peripherally supporting wall to provide peripheral support to said base of said jack when the jack is inserted into the receptacle and wherein said wall includes at least one elongated protruding element for providing lateral support to the base of the jack when the jack is inserted into the receptacle.

11. The receptacle for a jack of claim 10 wherein said wall of said recessed area is substantially cylindrical.

12. The receptacle for a jack of claim 10 further including a jack plug support structure adjacent said recessed area, said jack plug support structure including a front surface and a base extension area defined in said front surface and extending from said recessed area into which a portion of said base of said jack is fitted.

13. The receptacle for a jack of claim 12 wherein said base extension area defines a channel.

14. The receptacle for a jack of claim 10 wherein said wall of said recessed area has a long axis and wherein said at least one elongated protruding element is provided along said long axis of said recessed area.

15. The receptacle for a jack of claim 10 wherein said at least one protruding element defines three protruding elements.

16. The receptacle for a jack of claim 12 wherein said jack plug support structure includes said front surface, said jack plug support structure further includes a finger-receiving well formed in said front surface adjacent said recessed area.

17. The receptacle for a jack of claim 16 wherein said finger-receiving well defines a pair of finger-receiving wells formed in said front surface adjacent said recessed area.

18. The receptacle for a jack of claim 17 wherein said pair of finger-receiving wells are opposed.

19. A receptacle for a jack, the jack having a base and a pin, the receptacle comprising:

a receptacle support structure having a front surface;

a jack plug;

a recessed area defined in said support structure, said recessed area having a jack plug end in which said jack plug is fitted and a base supporting housing formed between said jack plug end and said front surface of said receptacle support structure, whereby at least a portion of said jack base is positionable within said recessed area; and a pair of substantially opposed finger-receiving wells formed in said front surface and extending laterally from said jack plug end.

20. The receptacle for a jack of claim 19, wherein said jack plug support structure includes a front surface and a base extension area defined in said front surface and extending from said recessed area into which a portion of said base of said jack is fitted.

* * * * *